United States Patent [19]

Leather

[11] 4,288,141

[45] Sep. 8, 1981

[54] INSULATION DISPLACEMENT CONTACT FOR AN ELECTRICAL CONNECTOR

[75] Inventor: Russell A. Leather, Perth, Scotland

[73] Assignee: Ferranti Limited, Cheadle, England

[21] Appl. No.: 100,107

[22] Filed: Dec. 4, 1979

[30] Foreign Application Priority Data

Dec. 8, 1978 [GB] United Kingdom ..... 47683/78

[51] Int. Cl.[3] ..... H01R 11/20; H01R 43/00

[52] U.S. Cl. ..... 339/97 R; 29/882

[58] Field of Search ..... 339/97 R, 258 R, 258 P, 339/95, 96, 97 P, 98, 99, 17 LC, 17 LM, 17 M, 17 L; 29/874, 882, 881

[56] References Cited

U.S. PATENT DOCUMENTS

Re. 26692 10/1969 Ruehlemann ..... 339/17 LX
3,805,214 4/1974 Demler ..... 339/97 R X
3,867,008 2/1975 Gartland ..... 339/258 R
4,118,103 10/1978 Leidy ..... 339/98

*Primary Examiner*—John McQuade
*Assistant Examiner*—John S. Brown
*Attorney, Agent, or Firm*—Kerkam, Stowell, Kondracki & Clarke

[57] ABSTRACT

A contact for an electric connector comprises a terminal element for connection to an electric conductor and a contact-making portion for connection to an electric circuit. The terminal element comprises two arms 10 and 11 joined by a link portion 12 and together defining a parallel sided notch 13. A double bend 23 is formed in the link portion and a second double bend 24 in one arm to produce a notch of the desired width. The contacting-making element may comprise two leak springs 16 and 17 forming a socket contract. A locating member 18 is also provided to locate the contact in a housing.

16 Claims, 6 Drawing Figures

INSULATION DISPLACEMENT CONTACT FOR AN ELECTRICAL CONNECTOR

This invention relates to an insulation-displacement contact for an electric connector, and to a connector including such contacts.

Wires for electrical connections are usually covered with an insulating material which must be removed before a satisfactory connection can be made. For example, the wire must be bared before making either a crimped or a soldered connection, but at the same time care must be taken to ensure that the wire is not damaged by the stripping process, and the length of wire bared must be confined within certain limits. A considerable proportion of the total cost of making a connection may be attributed to the removal of the insulation, and a system of making a connection which does not involve the removal of the insulation is clearly an improvement. It is also an advantage if a number of wires may be connected simultaneously rather than connecting each wire separately. If the wire is cut to length at the same time as the connection is made then a further time, and cost, saving is effected.

With these and other points in mind, a number of connection systems have been developed using what are referred to as "insulation-displacement contacts". The most common method is to force an insulated wire into a metallic member having a slot the width of which is slightly less than that of the metallic core. The insulation is displaced either by a shearing action or by a crushing action, or by a combination of the two. The bare wire is compressed in the slot to a degree which ensures a gas-tight joint which is essential for a good long-lasting connection between base metal connecting parts. However, the degree of compression must not be excessive, otherwise the wire will be weakened to such an extent that it will be mechanically unacceptable.

This type of contact is often referred to as a "notch" contact, and may be of very simple form. The notch is necessarily narrow to suit the diameter of the conductor, and its width must be held to close tolerances. A typical notch width is 0.203 mm (0.008 inch), maintained to a tolerance of ±0.0127 mm (0.0005 inch). These dimensions may cause manufacturing problems, particularly in cases where the metal thickness is greater than the width of the notch since this may cause damage to, or shorten the life of, the punch and die used to form the notch. In addition, the strain energy developed by the contact must not fall to an unacceptable level during the life of the contact.

It is an object of the invention to provide an insulation displacement contact for an electric connector which does not suffer from the above-mentioned disadvantages.

According to the present invention there is provided an insulation displacement contact for an electric connector which includes a terminal element for connection to an electric conductor and a contact-making element for connection to an electric circuit, the terminal element comprising two spaced arms joined together at one end by a link portion and together defining a parallel-sided notch, a first one of the arms being displaced relative to the other arm by a double bend formed in the link portion and being further displaced by a double bend formed in the said one arm to define, with the other arm, a notch of the required width.

Also according to the invention there is provided a method of manufacture of an insulation displacement contact for an electric connector having a terminal element for connection to an electric conductor and a contact-making element for connection to an electric circuit, which includes the steps of forming a contact member having two spaced arms joined at one end by a link portion and together defining a parallel-sided notch of greater than the required width, forming a double bend in the link portion to displace one arm relative to the other, and forming a further double bend in the said one arm such that the two arms together define a notch of the required width.

The invention also comprises a connector which includes a housing of electrically-insulating material in which are located a plurality of insulation-displacement contacts as defined above.

The invention will now be described with reference to the accompanying drawings, in which.

Figure 1:
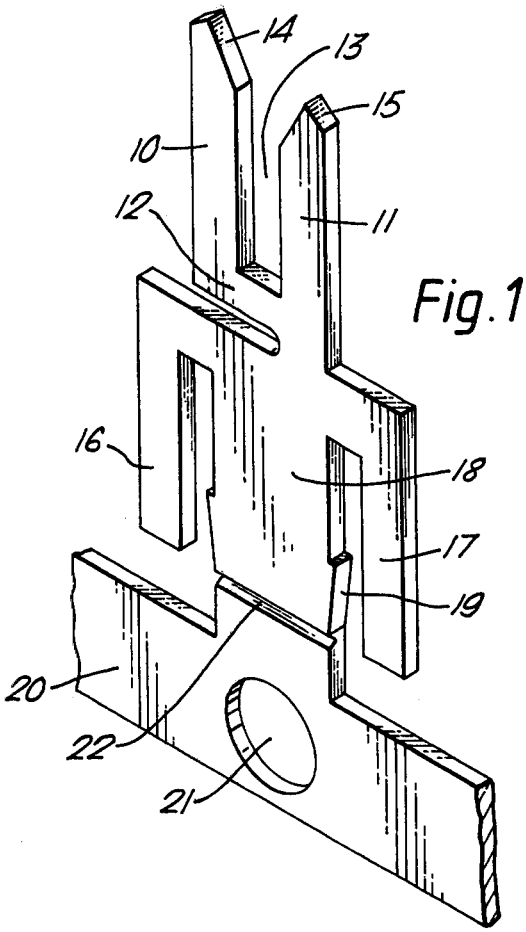
FIG. 1 is a perspective view of a stamped blank from which a contact is formed.

Referring now to FIG. 1, this shows a single stamping from which a contact will be formed. The stamping, of a suitable electrically-conducting material, has two arms 10 and 11 joined at one end by a link portion 12 and spaced apart to define a relatively wide notch 13. Arm 10 is slightly longer than arm 11. The free ends of arms 10 and 11 have steep chamfers 14 on one side and shallower chamfers 15 on the other side.

Below the link portion 12 the blank branches out into three parallel portions. The outer two limbs 16 and 17 are located on either side of a central locating limb 18 which has an enlarged portion 19 formed on it. The entire blank may be carried on a conventional bandolier 20 with pilot holes 21, and a chiselled portion 22 eases detachment of the blank from the bandolier.

Figure 2:
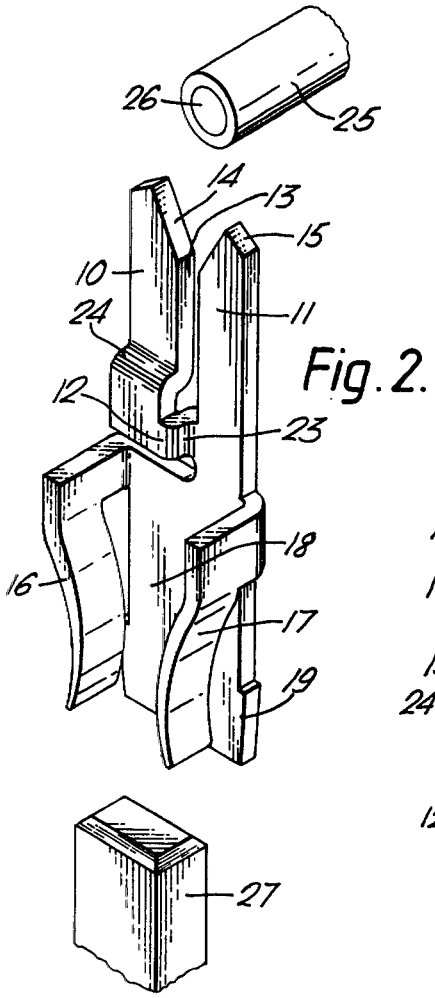
FIG. 2 is a similar view of a contact formed from the blank of FIG. 1.

FIG. 2 shows a completed contact, detached from the bandolier and after a number of bending and other operations have been performed. In the original blank, as shown in FIG. 1, all the portions lie in the same plane. However, in the forming of the finished contact the link portion 12 has a double bend 23 formed in it so that the longer arm 10 is displaced out of the plane of the arm 11. A second double bend 24, formed at the lower end of arm 10, restores the upper end of this arm to the plane of arm 11. The effect of these two double bends is to reduce the width of the notch 13 to the value necessary to form the terminal element of the contact, a value which is determined by the extent of the bends 23 and 24 and is therefore variable in manufacture. Also as a result of these two double bends both arms are now effectively of the same length. The chamfers 14 serve to guide a conductor with insulation 25, having a core 26, between the arms and into the notch 13, whilst the chamfers 15 serve to position a cover moulding in a complete connector.

The two lower limbs 16 and 17 are subjected to bending and forming operations which result in the formation of a contact-making element in the form of a conventional two-leaf contact with which, for example, a pin 27 may engage. The central locating limb 18 and its enlarged portion 19 serve to position and retain the contact in a suitable housing, as will be described below.

Figure 3:
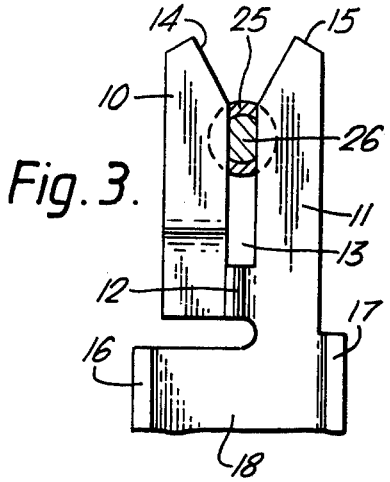
FIG. 3 is a front view of part of the contact of FIG. 2.

FIG. 3 shows part of the contact of FIG. 2 with a conductor in position in the notch 13. As will be seen from FIG. 3 the act of pressing the conductor into the notch 13 cuts through the insulation 25 of the conductor, whilst the edges of the notch compress the core 26 to form a satisfactory electrical connection. The increased length of arm 10 relative to arm 11 results in the arm 10 having a lower spring rate, and hence this reduces the likelihood of failure of the connection.

As already stated, the main feature of the contact described above is that the width of the notch 13, which is of great importance, may be accurately determined by two bending operations. It is possible by this means to maintain the required accuracy over a large number of contacts more easily than if it is determined purely by the condition of the punch and die used in the initial stamping operation. In addition, again as already stated, the width of the notch may be varied by varying the depth of the bends 23 and 24.

Figure 4:
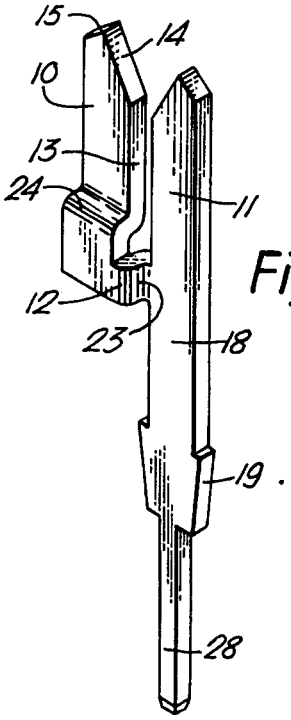
FIG. 4 shows an alternative form of contact.

The contact described above may be varied in a number of ways, particularly with respect to the contact-making element of the contact. The two-leaf contact shown in FIG. 2, arranged for engagement with a pin 27, may be replaced, for example, by a single pin extending from the locating limb 18 and which may be used for either wrapped or a soldered connection. FIG. 4 illustrates a connector of this type, in which the pin 28 extends from the central limb 18.

The contact may be formed with different locating and securing means to those provided by central limb 18 and the enlarged portion 19.

Figure 5:
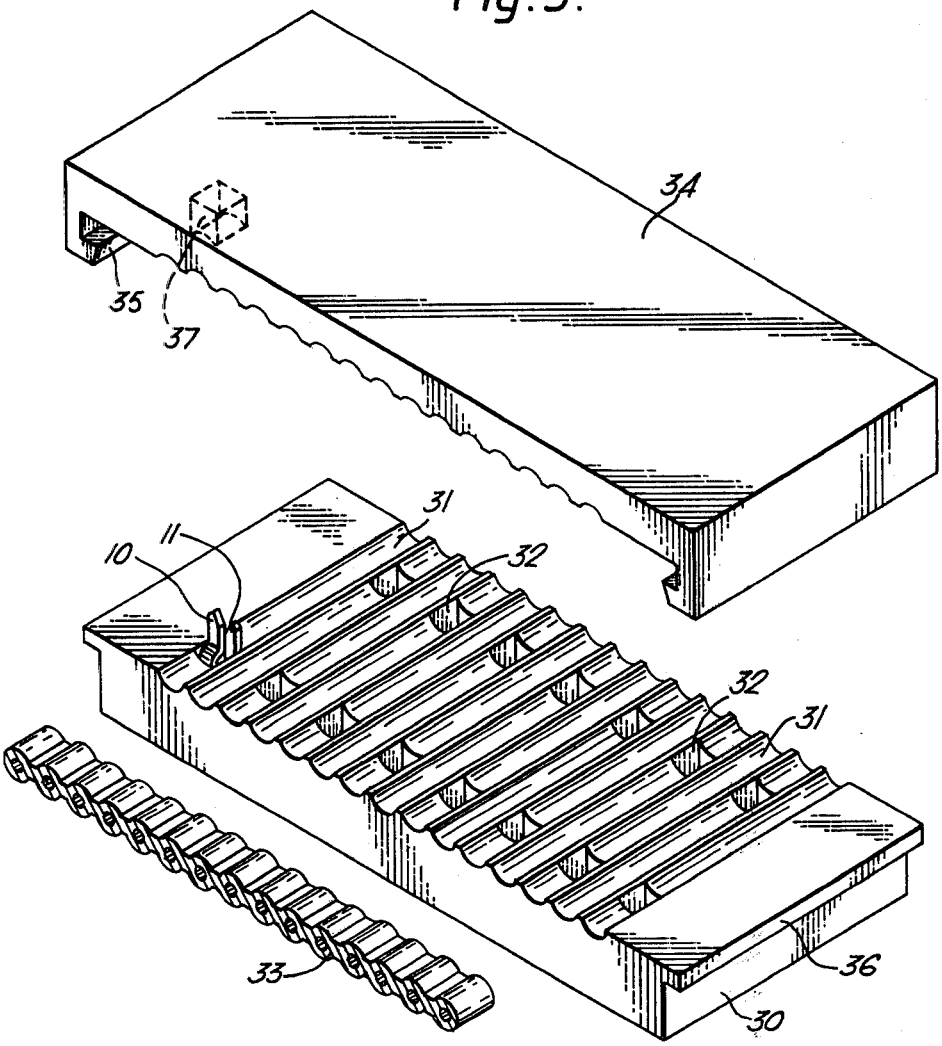
FIG. 5 shows the constituent parts of a connector.
Figure 6:
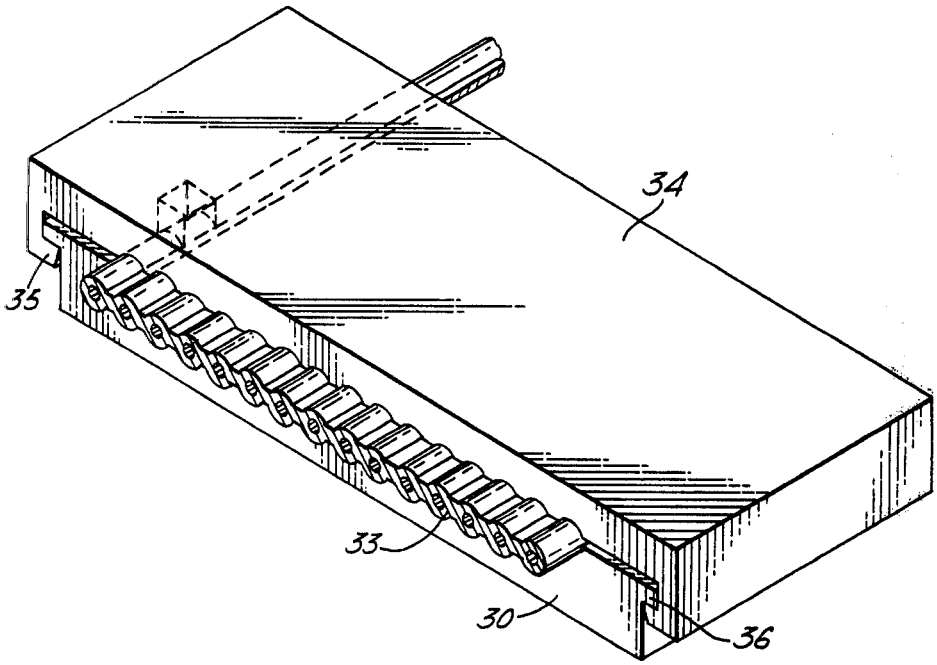
FIG. 6 shows an assembled connector.

The contact described above will normally be used in conjunction with a number of identical contacts all carried in a suitable insulating housing. Although such a connector may be used for connection to a number of separate conductors, a more common use is with flat ribbon cables, which consist of a number of separate conductors in a common insulating sheath. FIGS. 5 and 6 show the construction of a connector for use with such a cable.

Referring now to FIG. 5, this shows the component parts of a connector and part of a ribbon cable. An insulating block 30 has a number of channels 31 formed in it, and an aperture 32 is formed in each channel. Adjacent apertures may be offset as shown to improve the clearance between them. One of the apertures is shown with a connector inserted, with the arms 10 and 11 protruding into the channel 31. The remainder of each contact is located in the corresponding aperture 32. The form of the ribbon cable is shown at 33, and it will be seen that this conforms with the shape of the channels 31. An insulating cover 34 has a similar pattern of channels form in it, and carries projecting barbs 35 formed on it and arranged to engage ledges 36 on the block 30. In a position corresponding to that of each aperture 32 in the block 30, a recess 37 is formed in the cover 34, only one such recess being shown.

FIG. 6 shows an assembled connector with a ribbon cable in position. This cable may pass through the connector, so that each contact forms a Tee connection with a conductor, or may terminate in the connector. To form the connection of FIG. 6 the cable is placed in position over the block 30 of the connector, with each conductor lying over a separate contact. The cover 34 is then placed over the cable and pressed down into position. This action forces each conductor into its respective contact to form an electrical connection. The cover is held in position by the co-operating barbs 35 and ledges 36. It may be necessary to use a small hand press to force the cable and cover into position in the connector.

The connector illustrated in FIGS. 5 and 6 is only an example of a connector in which the contacts of FIGS. 1 to 4 may be used. Many other designs of connector are possible.

What we claim is:

1. An insulation-displacement contact for an electric connector which includes a terminal element for connection to an electric conductor and a contact-making element for connection to an electric circuit, the terminal element comprising two spaced arms joined together at one end by a link portion and together defining a parallel-sided notch, a first one of the arms being displaced relative to the other arm by a double bend formed in the link portion and being further displaced by a double bend formed in the said one arm to define, with the other arm, a notch of the required width to receive and displace insulation of an electric conductor.

2. A contact as claimed in claim 1 in which each arm is of rectangular cross-section, the first double bend displacing the first arm from the plane of the second arm into a plane parallel thereto, and the second double bend returning the first arm into the plane of the second arm.

3. A contact as claimed in claim 1 in which each arm has chamfers formed on its free end arranged to guide a conductor into the notch.

4. A contact as claimed in claim 1 in which said one arm is formed longer than the other arm such that after the formation of the two double bends each arm is of the same effective length.

5. A contact as claimed in claim 1 which includes locating means for locating the contact in a housing.

6. A contact as claimed in claim 5 including securing means for securing the contact in a housing.

7. A contact as claimed in claim 1 in which the contact-making element comprises two opposing resilient leaf-springs.

8. A contact as claimed in claim 1 in which the contact-making element comprises a terminal post.

9. A contact as claimed in claim 1 in combination with electric connector comprising a housing of electrically-insulating material and a plurality of said contacts mounted on said housing.

10. A method of manufacture of an insulation displacement contact for an electric connector having a terminal element for connection to an electricconductor and a contact-making element for connection to an electric circuit, which includes the steps of forming a contact member having two-spaced arms joined at one end by a link portion and together defining a notch of greater than the required width, forming a double bend in the link portion to displace one arm relative to the other, and forming a further double bend in the said one arm such that the two arms together define a notch of the required width to receive and displace insulation of an electric conductor.

11. A method as claimed in claim 10 in which the step of forming a contact member comprises stamping a contact member from a sheet of material.

12. A method as claimed in claim 11 in which the stamping operation forms chamfers on the free ends of the two arms.

13. A method as claimed in claim 11 in which the stamping operation forms at least one limb from which the contact making element of the contact may be formed.

14. A method as claimed in claim 10 in which a plurality of contacts are formed attached to a common strip of material.

15. A method as claimed in claim 14 which includes the step of severing each contact from the common strip of material.

16. A method as claimed in claim 10 including the steps of forming a housing of electrically-insulating material and locating on said housing a plurality of said contacts.

* * * * *